US008425381B2

(12) United States Patent
Forman

(10) Patent No.: US 8,425,381 B2
(45) Date of Patent: Apr. 23, 2013

(54) EXERCISER AND REHABILITATIVE DEVICE

(76) Inventor: Seth Gabriel Forman, Stanford, CT (US)

( * ) Notice: Subject to any disclaimer, the term of this patent is extended or adjusted under 35 U.S.C. 154(b) by 662 days.

(21) Appl. No.: 12/591,587

(22) Filed: Nov. 24, 2009

(65) Prior Publication Data

US 2010/0151995 A1 Jun. 17, 2010

Related U.S. Application Data

(60) Provisional application No. 61/117,357, filed on Nov. 24, 2008.

(51) Int. Cl.
*A63B 24/00* (2006.01)

(52) U.S. Cl.
USPC ..... 482/8; 482/1; 482/51; 482/901

(58) Field of Classification Search ..... 482/1–9, 482/51, 57, 91, 142, 907
See application file for complete search history.

(56) References Cited

U.S. PATENT DOCUMENTS 4,653,751 A * 3/1987 Green ..... 482/104
4,768,779 A * 9/1988 Oehman et al. ..... 482/10
4,830,363 A * 5/1989 Kennedy ..... 482/56
5,277,681 A * 1/1994 Holt ..... 482/112
5,335,649 A * 8/1994 Randall et al. ..... 601/24
5,913,749 A * 6/1999 Harmon ..... 482/49
6,409,635 B1 * 6/2002 Maresh et al. ..... 482/57
6,648,838 B1 * 11/2003 Brandon et al. ..... 600/587
6,840,892 B1 * 1/2005 Wu ..... 482/51
7,563,207 B1 * 7/2009 Burek ..... 482/91
8,197,393 B2 * 6/2012 Harmon ..... 482/142
2008/0161733 A1 * 7/2008 Einav et al. ..... 601/34
2009/0062074 A1 * 3/2009 Vick, Jr. ..... 482/8

* cited by examiner

*Primary Examiner* — Glenn Richman
(74) *Attorney, Agent, or Firm* — Roylance, Abrams, Berdo & Goodman, L.L.P.

(57) ABSTRACT

An exercise and rehabilitation apparatus including: a frame, an exercise device movably supported on the frame, and a user positioning unit connected with the frame, for properly positioning a user with respect to the exercise device and the frame for performance of a predetermined exercise. The exercise and rehabilitation apparatus also includes a device adjustment unit for positioning the exercise device with respect to the frame to properly position the exercise device with respect to a properly positioned user, to accommodate user size and shape diversity, the device adjustment unit permitting the exercise device to be alignable with a predetermined body part of the user. The exercise and rehabilitation apparatus further includes a feedback unit providing feedback to the user to indicate whether the predetermined exercise is being performed correctly.

17 Claims, 9 Drawing Sheets

EXERCISER AND REHABILITATIVE DEVICE

CROSS-REFERENCE TO RELATED APPLICATION

This application claims the benefit of Provisional Application No. 61/117,357, filed Nov. 24, 2008, in the United States Patent and Trademark Office, the entire disclosure of which is incorporated herein by reference.

BACKGROUND OF THE INVENTION

1. Field of the Invention

The present invention relates to exercise and rehabilitation devices, and more particularly, to exercise and rehabilitation devices that require little to no guidance from a professional to ensure proper exercise performance.

2. Description of the Related Art

Currently in the rehabilitation industry, patients are guided by a medical professional, such as a physical therapist, through movements that help coordinate musculature surrounding joints. These movements are an effort to alleviate stress experienced by ligaments and tendons that may occur due to muscular tension, injury or illness.

Rehabilitative exercise is generally restricted by limitations of the patient (i.e., body weight and dynamic proportions) and available equipment such as resistance and movement devices. Resistance devices include discrete weight bundles (i.e., dumbbells and other free weight devices) and resistance machines (including resistance bands or other devices which associate with universal uses) which generally includes the commonly referred smith-type machines (guided squat and shoulder press), angled guided presses (chest, shoulder and leg), angled guided pulls (back and leg) and typical arm strengthening machines (triceps, biceps and forearms).

Rehabilitative exercise is generally restricted by limitations of the patient (i.e., body weight and dynamic proportions) and available equipment such as resistance and movement devices. Resistance devices include discrete weight bundles (i.e., dumbbells and other free weight devices) and resistance machines (including resistance bands or other devices which associate with universal uses) which generally consists of the commonly referred smith-type machines (guided squat and shoulder press), angled guided presses (chest, shoulder and leg), angled guided pulls (back and leg) and typical arm strengthening machines (triceps, biceps and forearms).

Some movement devices include common gymnasium exercise equipment that may include cardiovascular enhancing machines such as treadmills, stair masters, pedal devices, rowing devices and a variety of other upper and lower body cardiovascular enhancing components.

Devices currently available offer sophisticated additions which, for example, are able to quantitatively measure force output and repetitions during gross motor movements, like during isokinetic leg extensions. Other devices may also employ ultrasound therapy, which can help the break-down of scar tissue that a patient has developed following injuries to the body, common about the ligaments and/or tendons.

Lately, a shift from the common staunch and stiff practice of using the devices heretofore mentioned has begun in the principles and philosophy of training. The shift is toward what is referred to as "biomechanical" (muscular coordination) training and development.

Currently, there are none or few "biomechanical" devices available that allow an injured, physically limited, or even healthy individual to execute motor movements without the general guidance of a trained physical therapist or other qualified professional. Further, there are none or few rehabilitative devices currently available that have the capacity to guide a patient through exercises that support "coordination correction." Generally speaking, devices noted above, which may be considered suitable otherwise, are of a somewhat complex nature, may not be designated for rehabilitative purposes, and do not provide sufficient positive mental reinforcement as increasing degrees of success are experienced.

Accordingly, there is a need for a rehabilitative device to support a biomechanical rhythm that provides an injured, physically limited, or healthy exerciser with an effective way to take advantage of corrective exercise that will help achieve physical with little to no supervision, minimal complexity, and maximized patient autonomy and confidence.

BRIEF SUMMARY

Accordingly, it is an aspect of the present invention to provide an exercise device, in particular an exercise device that allows rehabilitation patients as well as the general public to execute important coordination, strength, and stability exercises easily with minimal or no guidance from a physical therapist, health, or fitness professional.

The foregoing and/or other aspects of the present invention are achieved by providing an exercise and rehabilitation apparatus including: a frame, an exercise device movably supported on the frame, and a user positioning unit connected with the frame, for properly positioning a user with respect to the exercise device and the frame for performance of a predetermined exercise. The exercise and rehabilitation apparatus also includes a device adjustment unit for positioning the exercise device with respect to the frame to properly position the exercise device with respect to a properly positioned user, to accommodate user size and shape diversity, the device adjustment unit permitting the exercise device to be alignable with a predetermined body part of the user. The exercise and rehabilitation apparatus further includes a feedback unit providing feedback to the user to indicate whether the predetermined exercise is being performed correctly.

The foregoing and/or other aspects of the present invention are additionally achieved by providing a method of employing an exercise and rehabilitation apparatus, including the operations: positioning a user with respect to a frame of the apparatus and an exercise device that is moveably supported on the frame, for performance of a predetermined exercise; and positioning the exercise device with respect to the frame to properly position the exercise device with respect to a properly positioned user, to align the exercise device with a predetermined body part of the user. The method also includes providing mechanical feedback during performance of the exercise to the user to indicate whether the exercise is being performed correctly.

The foregoing and/or other aspects of the present invention are further achieved by providing an exercise and rehabilitation apparatus, including a frame; exercise means for performance of a predetermined exercise, the exercise means being movably supported on the frame; and user positioning means for properly positioning a user with respect to the exercise device and the frame. The exercise and rehabilitation apparatus also includes device adjustment means for positioning the exercise means with respect to the frame to properly position the exercise device with respect to the properly positioned user, to accommodate user size and shape diversity, the device adjustment means permitting the exercise means to be alignable with a predetermined body part of the user; and feedback means for providing feedback to the user to indicate whether the predetermined exercise is being performed correctly.

Additional and/or other aspects and advantages of the present invention will be set forth in part in the description that follows and, in part, will be apparent from the description, or may be learned by practice of the invention.

BRIEF DESCRIPTION OF THE DRAWINGS

The above and/or other aspects and advantages of embodiments of the invention will become apparent and more readily appreciated from the following detailed description, taken in conjunction with the accompanying drawings, of which.

DETAILED DESCRIPTION

Figure 1:
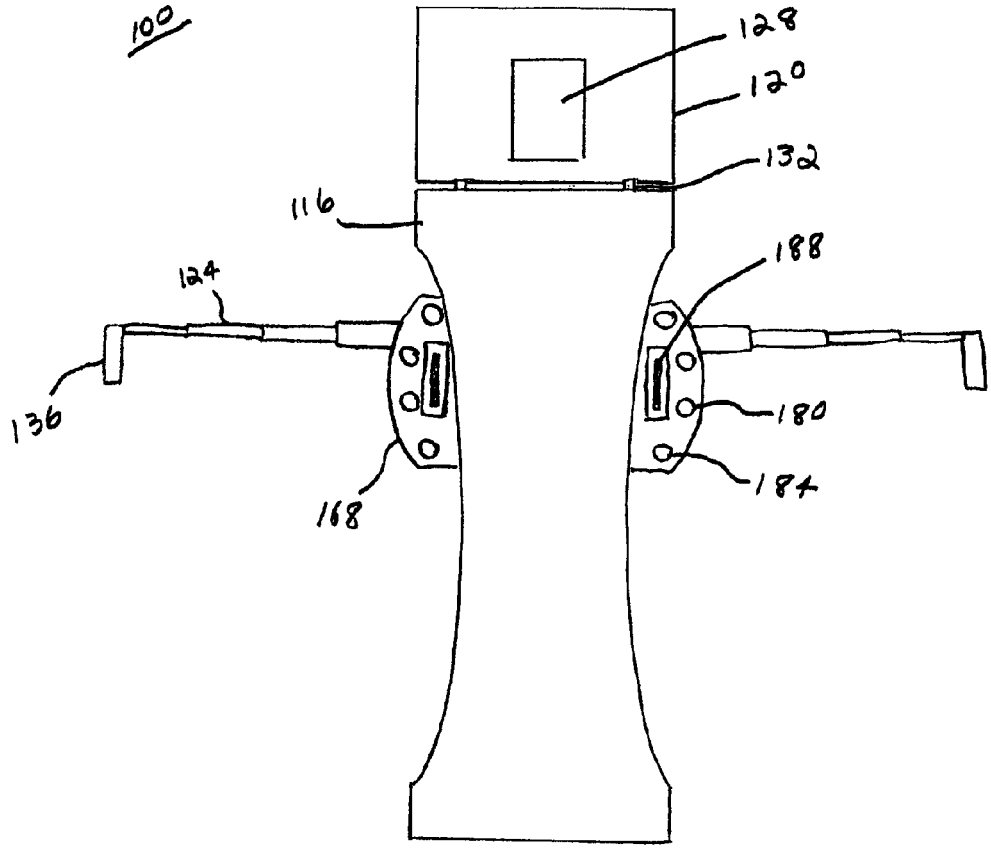
FIG. 1 illustrates a plan view of an exercise and rehabilitation apparatus in accordance with an embodiment of the present invention.

Reference will now be made in detail to embodiments of the present invention, examples of which are illustrated in the accompanying drawings, wherein like reference numerals refer to the like elements throughout. The embodiments described exemplify the present invention by referring to the drawings.

Various exercises correspond to particular muscles or muscle groups that are stressed while the exercise is performed. These exercises build strength in the muscle or muscle groups that are stressed during exercise. In addition to strength building, during "biomechanical" exercises a proprioceptive (the sense of the relative position of neighboring parts of the body) response within the stressed muscle or muscle group is also developed.

It is well known that joint instability may be a result of improper training techniques, genetics, and other injury. By alleviating or reducing joint instability maladies, the patient/user will naturally enjoy the benefits of a reduction in associated ligamentous injuries, which otherwise could lead to further instability and proprioceptive deficits (i.e., decreased neuromuscular control of consequence to chronic instability, joint instability and interminable pain).

For example, when the latisimus dorsi is overactive (as is common), such a state can lead to shoulder protraction, a position that results in internal rotation of the humerus and decreased space between the humerus and the clavicle. Essentially, the ligament holding the humerus and clavicle together may become pinched resulting in a condition known as impingement. In advanced cases, loss of motion may progress to a "frozen shoulder." In acute bursitis, the shoulder may be severely tender. All movement may be limited and painful. This condition, however, may be avoided through use of embodiments of the instant invention by methods explained herein or those available by use of embodiments of the instant invention by a skilled person in the related industry.

Figure 2:
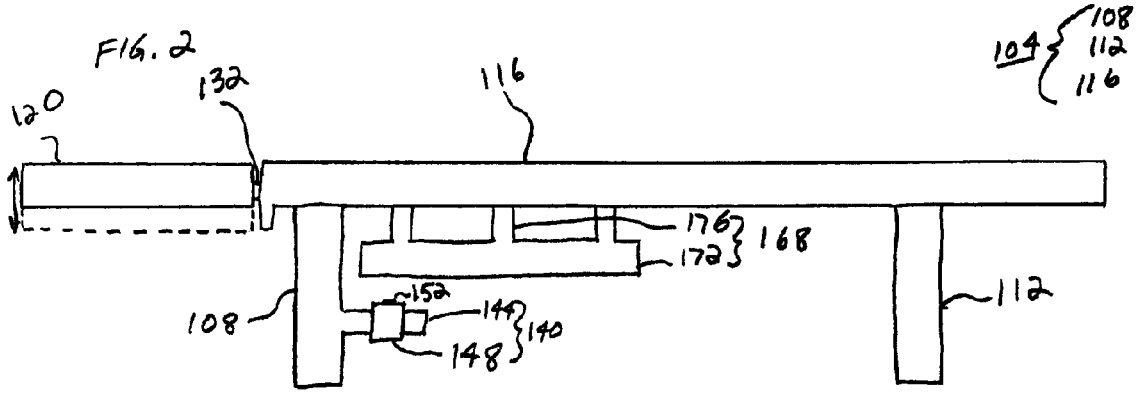
FIG. 2 illustrates a partially exploded side view of the apparatus of FIG. 1.

FIGS. 1 and 2 respectively illustrate plan and side views of an exercise and rehabilitation apparatus 100 in accordance with an embodiment of the present invention. The apparatus 100 includes a frame 104, which includes first and second vertical supports 108 and 112 and a table body 116 disposed atop the vertical supports 108 and 112. According to one embodiment, the first and second vertical supports 108 and 112 each include a pair of legs.

Additionally, according to one embodiment, the first and second vertical supports include a lift system for vertically positioning the table body. The lift system may be, for example, a hydraulic lift system. Thus, a user and/or a trained practitioner may adjust the height of the table body 116 above the floor. For example, a user may adjust the table body 116 to one height for performing an exercise on the table body 116. And a trained practitioner may adjust the table body 116 to a different height to use the table body 116 as a massage table or a work table. For convenience, but not by way of limitation, the exercise and rehabilitation apparatus 100 will hereinafter be referred to as an "exercise apparatus 100," or simply "apparatus 100." Additionally, the exercise apparatus 100 described herein can be employed by many people, including a rehabilitation patient, a healthy exerciser, and/or a caregiver, for example, a medical doctor, a nurse, or a physical therapist. For convenience, someone employing the exercise apparatus 100 is generally hereinafter referred to as a "user." Further, also for convenience, terms such as "vertical" and "horizontal" and "top" and "bottom" and "up" and "down" are employed to represent relative directions with respect to the exercise apparatus 100 disposed on a horizontal surface. It will be understood, however, that the exercise apparatus 100 is not limited to such an orientation, and that the exercise apparatus 100 may be employed, for example, on an incline.

As shown in FIG. 1, the apparatus 100 also includes a user positioning unit 120 connected with the frame 104, for properly positioning a user with respect to the frame 104 and an exercise device 124, for performance of a predetermined exercise. More specifically, in this embodiment, the user positioning unit 120 includes a head pad 120 that has a void 128, similar to a massage or chiropractic table. For proper positioning, the user lies face down (prone) on the table body 116, placing their forehead on the head pad 120 adjacent to the void 128 and positions their face within the void 128, thereby assuring a spine neutral position. As discussed in greater detail below, the head pad 120 is moveably connected with the frame 104 by a biasing connector 132 that permits the head pad 120 to move vertically with respect to the table body 116 if the force on the head pad 120 exceeds a predetermined level. This feature helps to prevent cervical flexion during exercises, for example, pulling movements.

FIG. 1 illustrates that the apparatus 100 also includes the aforementioned exercise device 124. More specifically, in this embodiment, the exercise device 124 includes a pair of arms 124 that are movably supported on the frame 104. According to one embodiment, the arms 124 each have a handle 136 that is rigidly connected to the respective arm 124 at a predetermined angle, for example, substantially 90°.

As illustrated in FIG. 1, the arms 124 telescope in and out to accommodate user arm-length diversity, so that the handles are alignable with the user's hands. According to one embodiment, the telescoping of the arms is linked. According to another embodiment, the arms 124 can telescope separately. Additionally, the arms 124 can telescope inwardly such that in a storage position, the arms 124 do not extend laterally outside the table body 116. In other words, the arms 124 can telescope sufficiently inwardly that they do not stick out from beneath the table body 116. Thus, this feature allows a physical therapist, for example, to use the exercise apparatus 100 as a work table or a massage table, without having to avoid the arms 124. Further, according to one embodiment, at least one segment of each arm 124 is rotatable with respect to a longitudinal axis of the arm 124. As will be discussed in greater detail below, this provides for different positioning of the handles 136 for different exercises.

According to one embodiment, the arms 124 are attached to the frame 104 via an arm attachment portion 140, which is disposed on the first vertical support 108, as shown in FIG. 2. In FIG. 2, the arms 124 have been removed for illustrative purposes. The arms 124 (as a unit) are longitudinally moveable with respect to the table body 116 along the arm attachment unit 140 to accommodate user size and shape diversity. According to one embodiment, the arm attachment unit 140 includes an attachment post 144 connected with the first vertical support 108, and a carrier 148 to which the arms 124 are connected. The carrier 148 is movable along the attachment post 144.

In one embodiment, the carrier 148 slides freely along the attachment post 144. According to another embodiment, the carrier 148 moves in discrete increments along the attachment post 144 via predetermined detents. Further, according to one embodiment, the arm attachment unit 140 also includes a carrier locking device 152 to lock the position of the carrier 148 with respect to the attachment post 144. The arms 124 are movably connected to the carrier 148. The connection of each arm 124 with the carrier 148 may be, for example, a universal joint, or a ball and socket joint.

According to one embodiment, the exercise apparatus 100 includes a sensing unit for automatically determining a user's size and shape. Such a sensing unit may include, for example, an optical scanner, or contact sensors within the table body 116. Further, according to one embodiment, the exercise apparatus 100 includes an automatic adjuster for automatically positioning the exercise device 124. Such an automatic adjuster may include, for example, a motor that automatically moves the carrier 148 with respect to the attachment post 144 in accordance with the size and shape information determined by the sensing unit, to automatically position the exercise device 124 with respect to the properly positioned user.

In one embodiment, the telescoping arms 124 work independently of each other (unilaterally), and may each move freely along an arc with respect to a longitudinal axis of the table body 116, to execute scapular retraction exercises at different angles. Additionally, in one embodiment, the arms 124 can be selectively operatively connected, for example, by gears or the like, to move in unison along respective arcs with respect to the longitudinal axis of the table body 116. Further, according to one embodiment, the arms 124 are positionable in predetermined Y and T configurations with respect to the table body 116.

Figure 3:
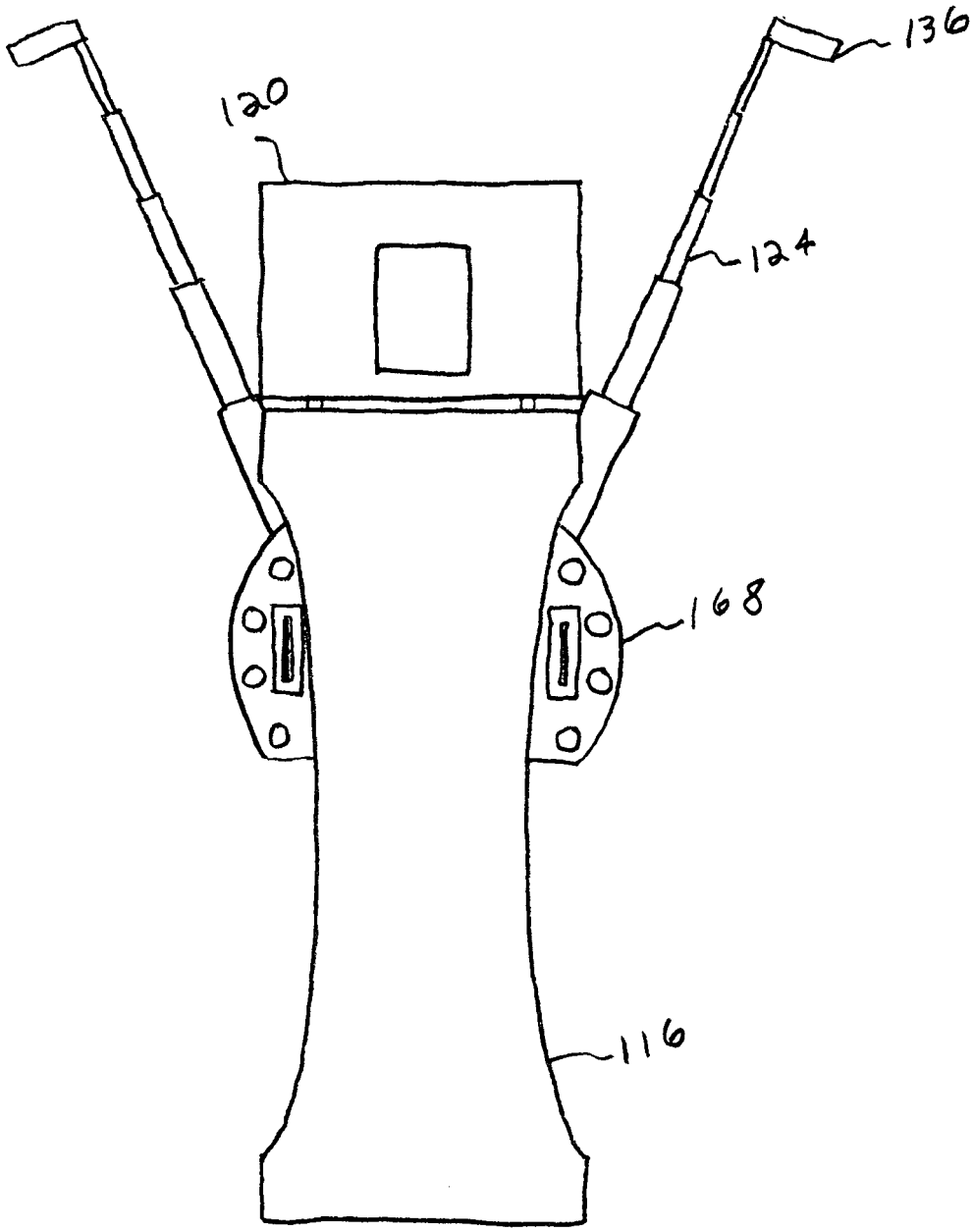
FIG. 3 illustrates a plan view of the apparatus of FIG. 1 in a Y configuration.

FIG. 1, for example, illustrates the arms 124 in the T configuration and FIG. 3 illustrates the arms 124 in the Y configuration. To properly position the arms 124 with respect to a properly positioned user (i.e., as noted above, prone with forehead on head pad 120 and face in void 128), when the arms 124 are in the T configuration, the user moves the carrier 148 along the attachment post 144 until the arms 124 are substantially aligned with a top of the user's shoulders.

Thus, the exercise apparatus 100 includes a device adjustment unit for positioning the arms 124 with respect to the frame 104 to properly position the arms 124 with respect to a properly positioned user. According to one embodiment, the device adjustment unit includes the telescoping arms 124, permitting the handles 136 to be alignable with the user's hands. According to another embodiment, the device adjustment unit includes the arm attachment unit 140, permitting the T-configured arms 124 to be alignable with the top of user's shoulders. According to yet another embodiment, the device adjustment unit includes both the telescoping arms 124 and the arm attachment unit 140, permitting the handles 136 to be alignable with the user's hands and the arms 124 (in the T configuration) to be alignable with the top of user's shoulders. Thus, the device adjustment unit permits the arms to be alignable with a predetermined body part of the user. Additionally, the device adjustment unit accommodates user size and shape diversity.

Further, according to one embodiment, the exercise apparatus 100 includes written instructions for positioning the T-configured telescoping arms 124 with respect to the top of the user's shoulders.

Figure 4:
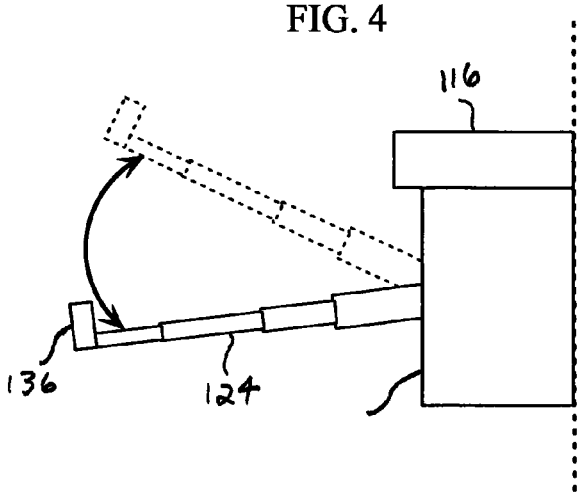
FIG. 4 is a partial end view of the apparatus of FIG. 1.

As noted above, the arms 124 can be configured in Y and T configurations. For exercises performed in the Y and T configurations, the telescoping arms 124 are extended to accommodate fully extended arms of the user. In such exercises, as shown, for example, in FIG. 4, from a downward position, the user lifts the arms 124 vertically until the user's arms are substantially planar with the trunk of the user's body, and then moves the arms 124 vertically back downward. According to one embodiment, the resistance to such vertical movement of the arms 124 is selectively variable, and can be set in accordance with the user's desire, or in consultation with, for example, a physical therapist. According to one embodiment, the resistance is provided by a hydraulic mechanism.

In addition, the arms 124 can be configured in a W configuration. The W configuration is substantially similar to the Y configuration, except that the arms 124 are telescoped inwardly. In the W configuration, as with the Y and T configurations, the user is prone on the table boy 116, with their forehead resting on the head pad 120 adjacent to the void 128, and their face is disposed in the void 128. The user's upper arms extend vertically downward, and the user's forearms extend horizontally therefrom at a substantially 90° angle to be substantially parallel to the user's spine. Grasping the handles 136, which are substantially vertical in the down position, the user maintains the relative position between their upper arms and forearms, and rotates their upper arms outward and upward, until the user's arms are substantially planar with the user's trunk, and the handles 136 are substantially horizontal. The resistance to such movement of the arms 124 is selectively variable, either by the user or by, for example, a physical therapist.

Figure 5A:
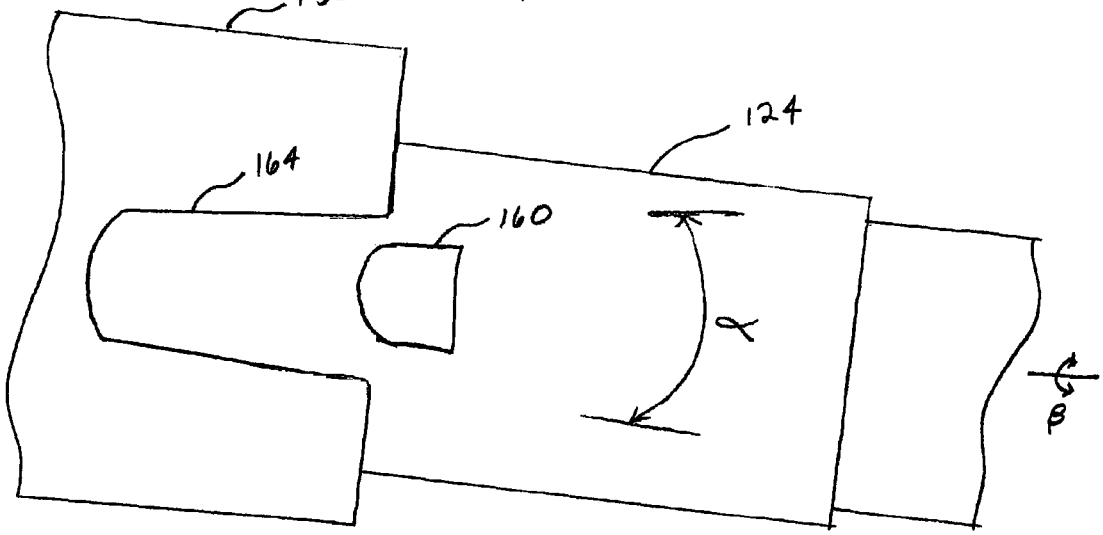
FIGS. 5A and 5B respectively illustrate a top view and a side cutaway view of a collar of the apparatus of FIG. 1.
Figure 5B:
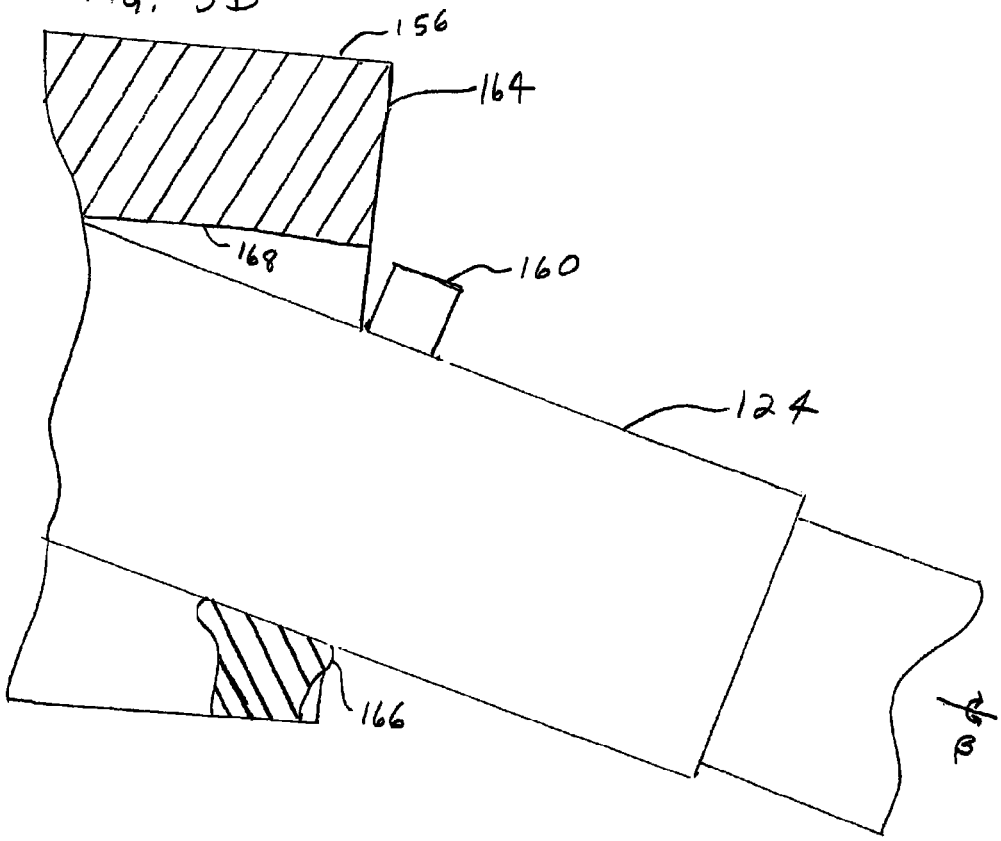

The exercise apparatus includes a collar 156 for each arm 124. According to one embodiment, the collars 156 are disposed on the carrier 148. The collars 156, in combination with respective protrusions 160 disposed on the arms 124, form a guidance and feedback mechanism to provide feedback to the user to indicate whether a given exercise is being performed correctly. FIGS. 5A and 5B respectively illustrate a top view and a side cutaway view of the collar 156. As shown in FIGS. 5A and 5B, the collar 156 has a guide or guide portion 164. For illustrative purposes, the tolerances between, for example, the protrusion 160 and the guide 164 are exaggerated in FIGS. 5A and 5B. In the Y and T (and W) configurations, the collar 156, via the guide 164 permits horizontal rotation of the arm 124 only within a first predetermined angular limit $\alpha$, such that horizontal rotation of the arm 124 beyond the angular limit a prevents vertical rotation of the arm, thereby indicating improper performance of the exercise. For example, in FIG. 5A, if the arm 124 is rotated beyond the angular limit $\alpha$, the protrusion 160 would pass beneath a shoulder 168 (see FIG. 5B) of the collar, and if the user attempted to raise the arm 124 vertically, the protrusion would catch on the shoulder 168 and prevent vertical motion of the arm 124, thereby providing feedback to the user that the exercise was not being performed properly. Conversely, if the user maintains horizontal rotation of the arm 124 within the first angular limit $\alpha$, then the protrusion 160 moves within the guide 156 and the user is able to vertically raise the arm 124, thereby indicating that the exercise is being performed correctly. According to one embodiment, the first angular limit $\alpha$ is substantially within 20°. According to one embodiment, the first angular limit $\alpha$ is substantially within 10°.

Additionally, according to one embodiment, the collar 156 permits rotation of the arms 124 about a longitudinal axis of the arms but prevents vertical rotation of the arms 124 if the rotation of the arms 124 about the longitudinal axis of the arms exceeds a second predetermined angular limit $\beta$, thereby indicating improper performance of the exercise. For example, if, in the Y and T configurations, proper performance of the exercise requires that the handles 136 be substantially vertical, if the user rotates the arms 124 beyond the second angular limit $\beta$, the protrusion 160 would catch on the shoulder 168 and prevent the user from lifting the arms 124 vertically, thereby providing feedback to the user that the exercise was not being performed properly. Conversely, if the user maintains axial rotation of the arm 124 within the second angular limit $\beta$, then the protrusion 160 moves within the guide 156 and the user is able to vertically raise the arm 124, thereby indicating that the exercise is being performed correctly. According to one embodiment, the second angular limit $\beta$ is substantially within 20°. According to one embodiment, the second angular limit $\beta$ is substantially within 10°.

It will be understood by one skilled in the art that in another embodiment, that arms 124 may have a plurality of protrusions 160 for guiding the movement of the arms 124 in various configurations. It will also be understood by one skilled in the art that in another embodiment, the protrusions 160 and/or the guides 164 may be curved. Further, it will be understood by one skilled in the art that in another embodiment, the protrusions 160 may be disposed on the collars 156, and the guides 164 may be disposed on the arms 124.

Additionally, according to one embodiment, the collar 156 includes a cushioning unit 166 (see FIG. 5B) to provide a cushioned ending of the downstroke of the arms 124.

Referring back to FIG. 2, as noted above, the head pad 120 is moveably connected with the frame 104 by the biasing connector 132. The biasing connector 132 biases the head pad 120 to a position in which a top surface of the head pad 120 is substantially planar with a top surface of the table body 116. Additionally, the biasing connector 132 permits the head pad 120 to move vertically downward with respect to the table body 116 if the force on the head pad 120 exceeds a predetermined level. For example, once a user is properly positioned on the exercise device 100 (forehead resting on the head pad 120 adjacent to the void 128, and their face disposed in the void 128), if the user improperly puts too much force on the head pad 120 via their forehead and/or chin when they lift the arms 124 vertically, the head pad 120 moves vertically downward, thereby indicating improper performance of the exercise. Conversely, if the user does not exceed the predetermined force, then the top surface of the head pad 120 remains substantially planar with the top surface of the table body 116, thereby indicating that the exercise is being performed correctly. Thus, the biasing connector 132 helps to prevent cervical flexion during exercises.

According to one embodiment, the biasing connector is linked with the arms 124 via a linking connector, such that if the head pad 120 moves vertically downward, the arms 124 are prevented from being vertically raised.

Thus, the exercise apparatus 100 includes a feedback unit providing feedback to the user to indicate whether the exercise is being performed correctly. According to one embodiment, the feedback unit includes the biasing connector 132. According to another embodiment, the feedback unit includes the collar 156. According to yet another embodiment, the feedback unit includes both the biasing connector 132 and the collar 156.

Figure 6:
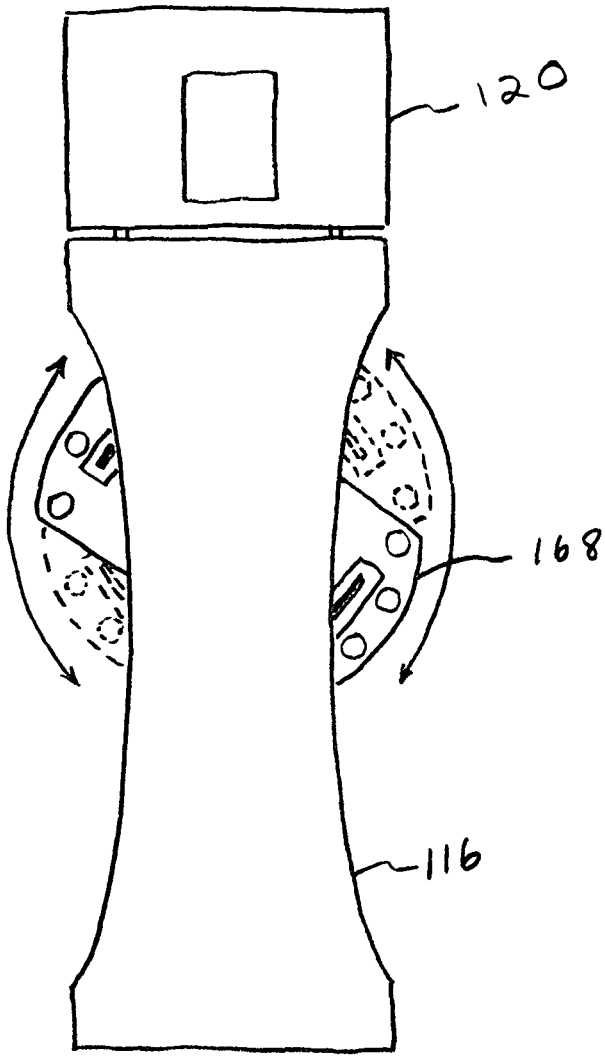
FIG. 6 illustrates a rotational storage apparatus of the apparatus of FIG. 1.

FIG. 6 illustrates a rotational storage apparatus 168 of the exercise apparatus 100. Referring to FIGS. 1-3, and 6, the rotational storage apparatus includes a storage portion 172 and a rotational connection portion 176 rotationally connecting the storage portion 172 and the table body 116. According to one embodiment, the storage portion 172 includes at least one anchoring point 180 for anchoring a therapeutic elastic resistance band to the storage portion 172. Therapeutic elastic resistance bands come in a variety of different levels of resistance. If the user is properly positioned on the table body 116, for example, by a physical therapist, the user can perform a variety of exercises employing the therapeutic elastic resistance bands. For example, if properly positioned, the user can perform prone external arm rotation, external arm rotation side-lying, or other exercises employing a therapeutic elastic resistance band.

Additionally, according to one embodiment, the storage portion 172 includes at least one band storage portion 184 for storing a therapeutic elastic resistance band. Further, according to one embodiment, the storage portion also includes at least one resistance handle 188 that is attached to a resistance cable that rests within the storage portion. The resistance cable and resistance handle 188 are biased toward a retracted position. According to one embodiment, the resistance of the resistance handle 188 and resistance cable is selectively variable, and may be set by the user, or, for example, by a physical therapist. The resistance handle 188 and resistance cable can also be used for prone external arm rotation and external arm rotation side-lying, as well as supine arm extension. The variety of options for shoulder coordination and strengthening movements helps make the rotational storage apparatus 168 a valuable component for shoulder (rotator cuff) health. Because of the variety of exercises available via the additional equipment of the rotational storage apparatus, the rotational storage apparatus 168 may increase the efficiency of an exercise workout for a user because the user can perform several exercises at the same apparatus.

As shown for example, in FIG. 6, the rotational storage apparatus 168 can rotate so that in a storage position, the rotational storage apparatus 168 does not extend laterally from underneath the table body 116. Thus, this feature allows a physical therapist, for example, to use the exercise apparatus 100 as a work table or a massage table, without having to avoid the rotational storage apparatus 168.

Figure 7:
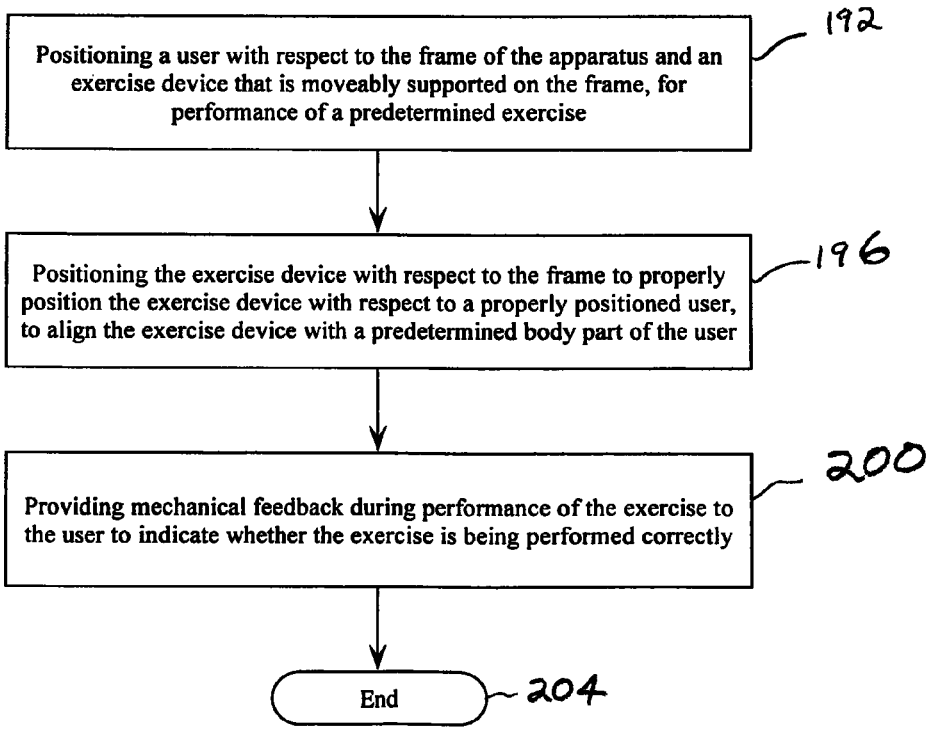
FIG. 7 is a flowchart illustrating a method of employing the apparatus of FIG. 1.

FIG. 7 is a flowchart illustrating a method of employing the exercise apparatus 100. The first operation 192 includes positioning the user with respect to the frame 104 of the apparatus 100 and an exercise device 124 that is moveably supported on the frame 104, for performance of a predetermined exercise. The method proceeds to operation 194: positioning the exercise device 124 with respect to the frame 104 to properly position the exercise device 124 with respect to a properly positioned user, to align the exercise device 124 with a predetermined body part of the user. Next, the method proceeds to operation 196: providing mechanical feedback during performance of the exercise to the user to indicate whether the exercise is being performed correctly, after which the method ends 198.

According to one embodiment, there are instructions on the respective exercise apparatuses for properly positioning the user with respect to the various frames and the various exercise devices, as well as instructions for positioning the various exercise devices with respect to the properly positioned user.

Figure 8A:
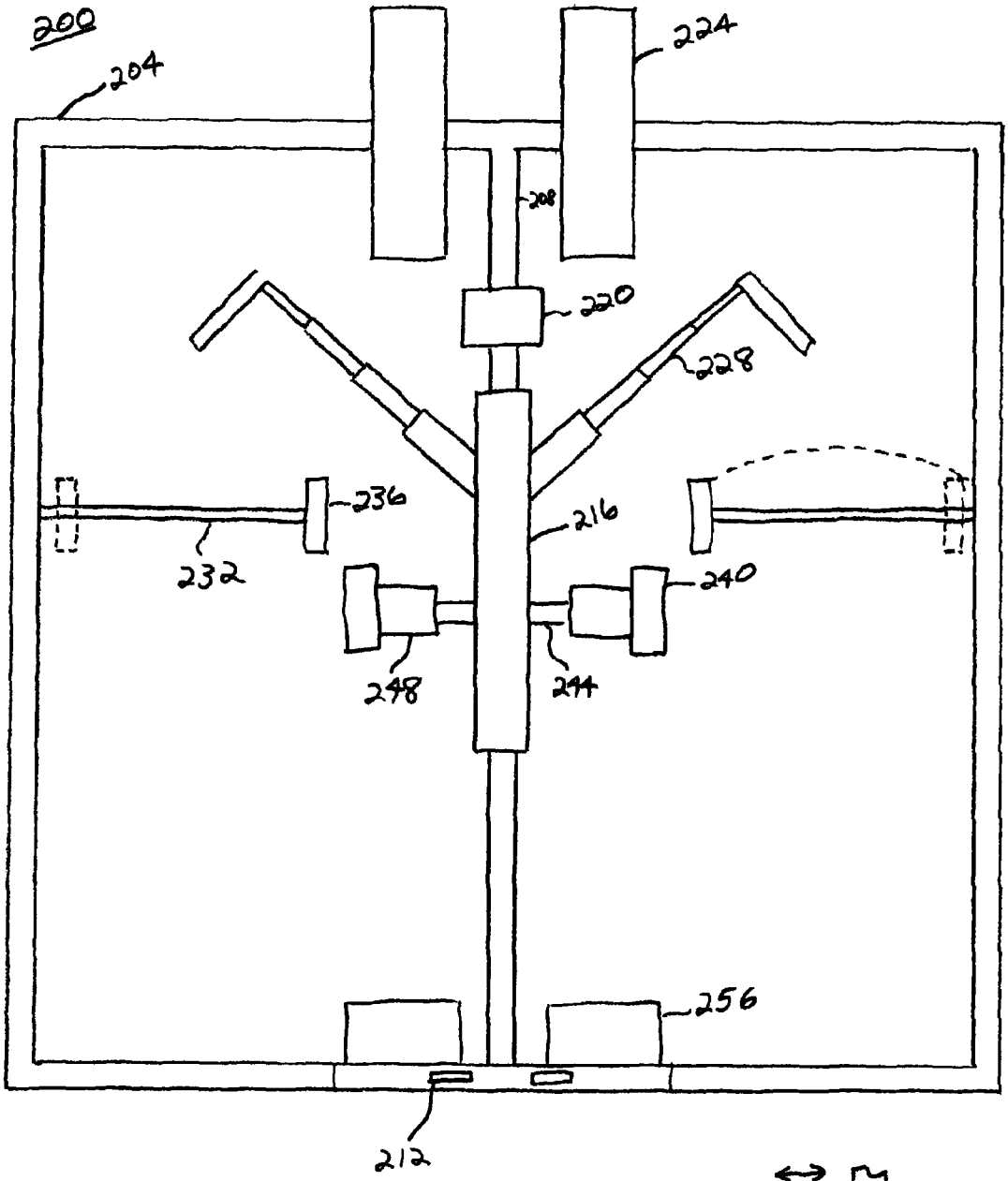
FIG. 8A illustrates a front view of an exercise and rehabilitation apparatus in accordance with an embodiment of the present invention.

FIG. 8A illustrates a front view of an exercise and rehabilitation apparatus 200 in accordance with an embodiment of the present invention. The exercise apparatus 200 includes a frame 204 that has a central portion 208 that is hingedly connected to a top of the frame 204. In its standard position, the central portion 208 is substantially vertical. The bottom of the central portion 208 may be pulled outwardly (with the central portion 208 telescoping appropriately to maintain contact with the ground) using, for example, handles 212, to angle the central portion with respect to vertical. This angled positioning provides a user the opportunity to use gravity as a form of resistance in at least some of the exercises available with respect to the central portion 208. Additionally, such angle positioning may increase the user's comfort of some of the exercises available with respect to the central portion 208. The exercise apparatus 200 is primarily for performance of upper body exercises.

As shown in FIG. 8A, a body pad 216 is fixedly disposed on central portion 208 for properly positioning a user with respect to the frame 204 and with respect to various exercise devices disposed on the frame 204. Additionally, as discussed in greater detail below, a head pad 220 is movably disposed on the central portion for properly positioning a user with respect to the frame 204 and with respect to various exercise devices disposed on the frame 204.

To properly position the user for a first set of exercises employing hand pads 224, which are movably disposed on a top of frame 204, the user places the anterior surface of their body (trunk) on the body pad 216 and linearly adjusts the head pad 220 along the central portion 208 so that their forehead rests on the head pad 220. Failure to maintain anterior contact with the body pad 216 and forehead contact with the head pad 220 indicates that the hand pad exercises are not being performed correctly. According to one embodiment, hand pads 224 are hingedly attached to the top of frame 204 to allow a change of angle. Once properly positioned, the user uses their fingers to crawl up hand pads 224 while extending their arm(s) to the point of a stretch and/or lengthened position in the latisimus dorsi. By lengthening the latisimus dorsi, the muscle's ability to activate is limited.

Next, the user rotates their hand(s) so that the palm is turned medially and the thumb is pointing posteriorly. The user then may raise their hand(s) off pads 10, while moving the arm and shoulder posteriorly. This movement will be carried out by the supraspinatus, infraspinatus, and teres minor (musculature of the rotator cuff). This exercise forces an increase in activation of the above mentioned musculature, resulting in improved stability responses about the shoulders during common daily movements.

With the user in the same position as for exercises with the hand pads 224 (anterior body surface in contact with body pad 216 and forehead in contact with head pad 220), the user can also perform exercises with telescoping arms 228. Telescoping arms 228 are similar in structure and function to telescoping arms 124, and thus, further description thereof is omitted for brevity. One difference, however, is that rather than moving arms 228 vertically to perform various Y, T, and W configuration exercises, the user moves the arms perpendicularly with respect to central portion 208. And in addition to the feedback from the collar, like the hand pad exercises, failure to maintain anterior contact with the body pad 216 and forehead contact with the head pad 220 indicates that the telescoping arm exercises are not being performed correctly.

Additionally, with the user in the same position as for exercises with the hand pads 224 (anterior body surface in contact with body pad 216 and forehead in contact with head pad 220), the user can also perform exercises with a second set of telescoping arms 232. Once again, failure to maintain anterior contact with the body pad 216 and forehead contact with the head pad 220 indicates that the second telescoping arm exercises are not being performed correctly. Handles 236 are attached to the second set of telescoping arms 232, which telescope towards the body pad 216 from lateral sides of the frame 204, to accommodate user arm length diversity. The second telescoping arms 232 are rotatably connected to the lateral sides of the frame 204. Additionally, to accommodate different user heights, second telescoping arms 232 are vertically adjustable with respect to the frame 204. To properly position the second telescoping arms 232, the user aligns the arms 232 with the top of the user's shoulder.

To perform the exercises with the second telescoping arms 232, the user maintains anterior contact with the body pad 216 and forehead contact with the head pad 220, and with arms extended parallel to the ground while holding handle(s) 236, the user rotates handle(s) 232 as far as the range of motion allows (in both directions, i.e., anterior and posterior rotation). The placement of the body pad in correlation with the rotating arms(s) 232 and handle(s) 236 ensures that the user is properly aligned and gains beneficial intermuscular coordination about the rotator cuff. Further, the internal and external rotation of the humerus with the arms extended is controlled and/or stabilized by the supraspinatus, infraspinatus, teres minor, deltoids, latisimus dorsi, rhomboids, trapezius, and pectoralis groups. This exercise can help prevent conditions such as impingement and shoulder protraction (the pre-curser to impingement). According to one embodiment, resistance of the rotation of the second telescoping arms 232 is selectively variable.

Figure 8B:
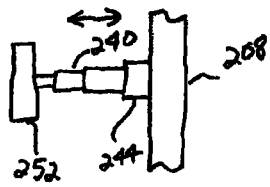
FIG. 8B illustrates a side view of an internal/external rotation telescoping arm of the apparatus of FIG. 8A.

To properly position the user with respect to the frame 204 and a third set of telescoping arms 240, the user adjusts head pad 220 along central portion 208 so that the top of the head pad 220 is even with the top of the user's head. The user then places the anterior surface of the user's body against the body pad 216. As shown in FIG. 8B, which is a side view of the third telescoping arms 240, the third telescoping arms 240 telescope substantially perpendicularly forward and backward with respect to the central frame 208. The third telescoping arms 240 are rotatably connected with a horizontal bar 244 that is movable along the central frame to accommodate diversity of user height. Additionally, the lateral positioning of the third telescoping arms 240 with respect to the central portion 208 is adjustable to accommodate diversity of user size and shape. Further, the lateral positioning of elbow pads 248 with respect to the central portion 208 is adjustable to accommodate diversity of user size and shape (i.e., upper arm and horizontal torso width). According to one embodiment, the horizontal bar 244 telescopes to adjust lateral positioning of the elbow pads 248 and third telescoping arms 240. According to another embodiment, the elbow pads 248 and third telescoping arms 240 slide along the horizontal bar 244 to adjust the lateral positioning thereof. Thus, to properly position the user with respect to the frame 204 and the third set of telescoping arms 240, the user also adjusts horizontal bar 244 along the central portion so that the bottom of the elbow pads 248 is even with the user's elbows when their arms are down at their sides. Further, the user laterally positions the elbow pads so that the elbow pads contact the user's elbow when the arms are at the user's sides. Further still, according to one embodiment, the user adjusts the lateral positioning and the telescoping of the third telescoping arms 240 so that the user can grasp handles 252 of the third telescoping arms 240 when the user's elbows are in contact with the elbow pads 248.

To properly perform the exercises with the third telescoping arm(s) 240, the user maintains elbow contact with the elbow pads 248, maintains posterior body contact with the body pad 216, maintains contact between the back of the user's head and the head pad 220, and rotates the third telescoping arm(s) 240 internally and/or externally with respect to the horizontal bar 244. According to one embodiment, resistance of the rotation of the third telescoping arm(s) 240 is selectively variable. Failure to maintain at least elbow contact with the elbow pads 248 and posterior body contact with the body pad 216 indicates improper performance of the exercise According to one embodiment, a pair of foot plates 256 are rotatably engaged with a bottom portion of the central portion 208 and are generally angled in the direction of body pad 216 at any angle of comfort to the user. According to on embodiment, the angle is approximately 4°. When the user steps on the foot plates 256, the foot plates 256 may press towards body pad 20 by spring force, tension, or gravity. Foot plates 256 allow the user to angle the exercises which increases overall effectiveness of the apparatus. The size of the footplates 256 are exaggerated in FIG. 8A for illustrative purposes.

Figure 9A:
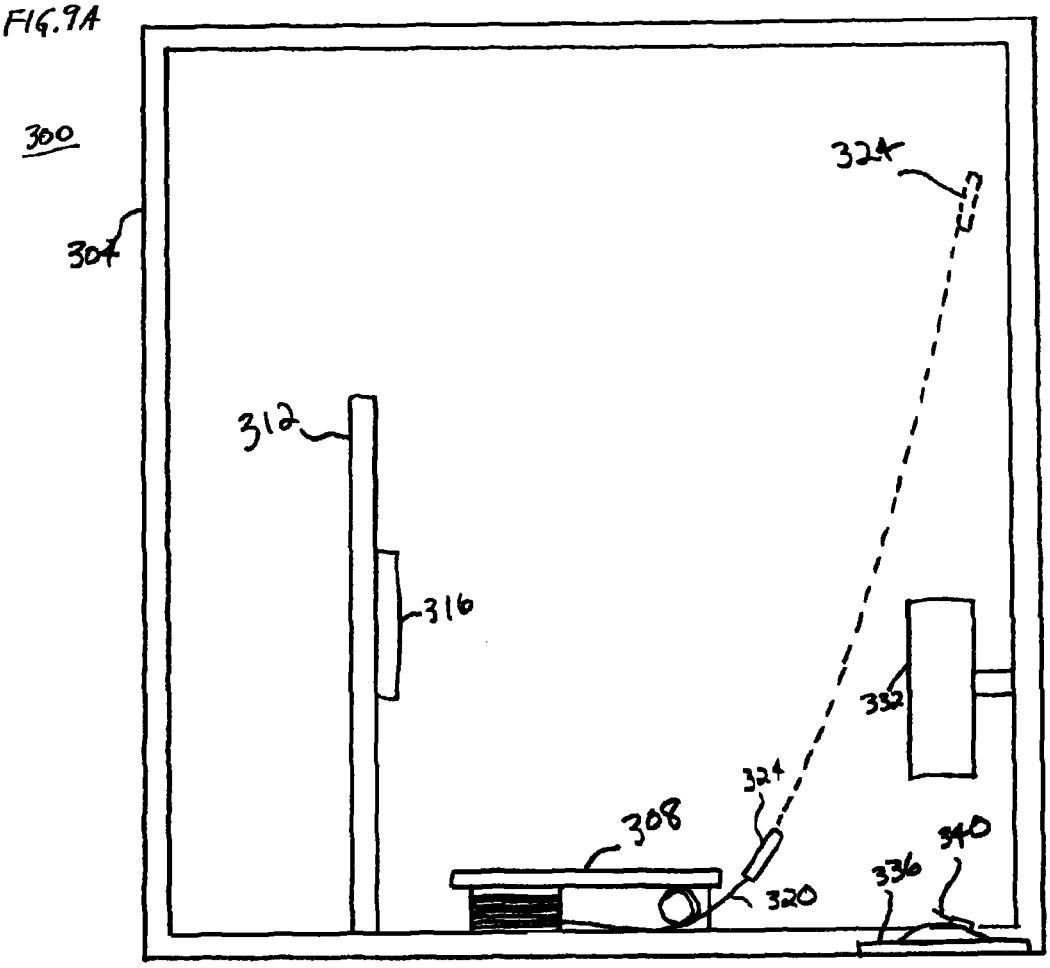
FIG. 9A illustrates a front view of an exercise and rehabilitation apparatus in accordance with an embodiment of the present invention.
Figure 9B:
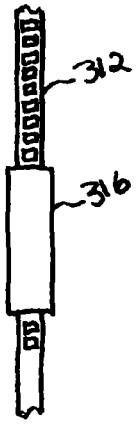
FIG. 9B illustrates a side view of a vertical bar of the apparatus of FIG. 9A.

Turning to FIG. 9A, which illustrates a front view of an exercise and rehabilitation apparatus 300 in accordance with an embodiment of the present invention, the exercise apparatus 300 exercise apparatus 300 is primarily for performance of lower body exercises. The exercise apparatus 300 includes a frame 304, a foot plate 308, and a vertical bar 312. The foot plate 308 is raised with respect to a bottom portion of the frame 304. According to one embodiment the foot plate 308 is raised approximately four inches from the bottom portion of the frame 304. An adjustable pad 316 is movably disposed on the vertical bar 312. More specifically, the adjustable pad 316 is movable along the vertical bar 312 to accommodate a diversity of user size and shape. A side view of the vertical bar 312 and the adjustable pad 316 are shown in FIG. 9B. The edge of the foot plate 308 nearest the vertical bar 312 is horizontally spaced from the face of the adjustable pad 316. According to one embodiment, the edge of the foot plate 308 nearest the vertical bar 312 is horizontally spaced approximately three inches from the face of the adjustable pad 316.

Additionally, the exercise apparatus 300 includes a resistance cable 320 with a handle 324. According to one embodiment, the resistance cable 320 is disposed beneath the foot plate 308, and is biased to a retracted position. The resistance on the resistance cable 320 is selectively variable. The combination of the foot plate 308, the vertical bar 312, the adjustable pad 316, and the resistance cable 320 can be employed for a specific gluteus activation exercise.

To be properly positioned for use of the combination of the foot plate 308, the vertical bar 312, the adjustable pad 316, and the resistance cable 320, standing on the foot plate 308 and facing away from vertical bar 312, the user's heel should be aligned with the rear edge of the foot plate 308. And to adjust the exercise device to accommodate diversity of user leg length, standing on the foot plate 308, the user should adjust the adjustable pad 316 so that the top of the adjustable pad 316 is substantially level with the user's waist. Additionally, according to one embodiment, height ranges may be printed on the vertical bar 312 to assist the user in positioning the adjustable pad 316.

The gluteus activation exercise is performed by standing with either a double or single leg on foot pad 308 with and the resistance handle(s) 324 held in one or both hands. The movement of the exercise begins by sitting the hips back and up towards the adjustable pad 316 while simultaneously leaning forward with the upper body and maintaining a supportive upper body posture. Knee(s) should remain vertically above the ankle(s) and bodyweight supported completely in the heel(s) towards the outside edge of the foot to ensure the gluteus and high hamstrings activation and plantar fascial (arch) support. From the bent over position the user will then raise the resistance handle(s) 324 with strait arms anteriorly providing a strong isometric contraction in the gluten and hamstrings, while simultaneously forcing ankle, knee, hip, spinal and scapular stabilizers to develop proper coordination. The resistance handle 324 is raised to shoulder height, and is then lowered down to knee height. During performance of the exercise, hand(s) should be substantially aligned with the knee(s). This single exercise is a precursor to safe squatting and lunging movements as well as improved gait and athletic movements. Additionally, according to one embodiment, the handle is shaped so that the palms are vertical during performance of the exercise.

Different resistance handles 135 may be accommodated for this exercise, such as double or single arm handles. A double handle typically has two handles parallel and attached to each other, with a cable attachment ring located on its inferior cross bar. A single arm handle is one straight round bar with a cable attachment ring on its inferior end.

Figure 9C:
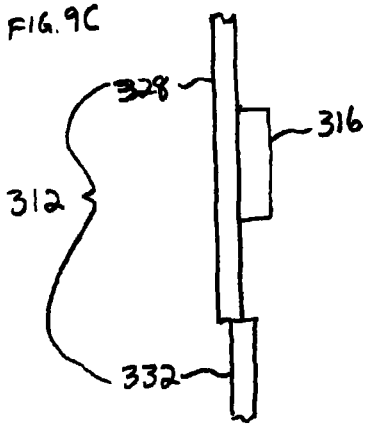
FIG. 9C illustrates movement of the vertical bar of FIG. 9A.

During the exercise, though the gluteus should contact the adjustable pad 316, the user's weight should be supported by the user's leg(s), not by the adjustable pad 316. To this end, an upper portion 328 of the vertical bar 312 is movably disposed with respect to a base 332 of the vertical bar 312 (as shown in FIG. 9C), so that if a horizontal force on the adjustable pad 316 exceeds a predetermined amount, the upper portion 328 moves horizontally by a predetermined amount. This movement of the upper portion 328 and adjustable pad 316 is to provide feedback to the user to indicate that the exercise is being performed incorrectly.

As shown, the exercise apparatus 300 also includes a vertically adjustable knee pad 332 that is movably connected with the frame 304 to accommodate diversity of user size and shape. The knee pad 332 is used in combination with a foot plate 336 to increase mobility in the sub-taylor joint. The foot plate 336 is also connected with the frame 304. Sub-taylor joint mobility can be increased by placing the foot flat on foot plate 336. A stabilizer 340, such as a strap, hook, or loop may be used in conjunction with the foot plate 336 and go over the anterior surface of the ankle. Once stabilized, the user presses his knee forward to knee pad 332 while keeping the heel on the floor. This exercise helps to increase dorsiflexion, resulting in the achievement of greater depths during various squats and lunges as well as increased efficiency during gait, and athletic movements. When exercisers or rehabilitation patients execute squats, lunges, or athletic movements, such as box jumps, they may display an inability to maintain proper spinal alignment and balance. Many times a simple sub-taylor joint release can drastically improve individual performance during such movements, helping avoid unnecessary injuries.

Figure 10A:
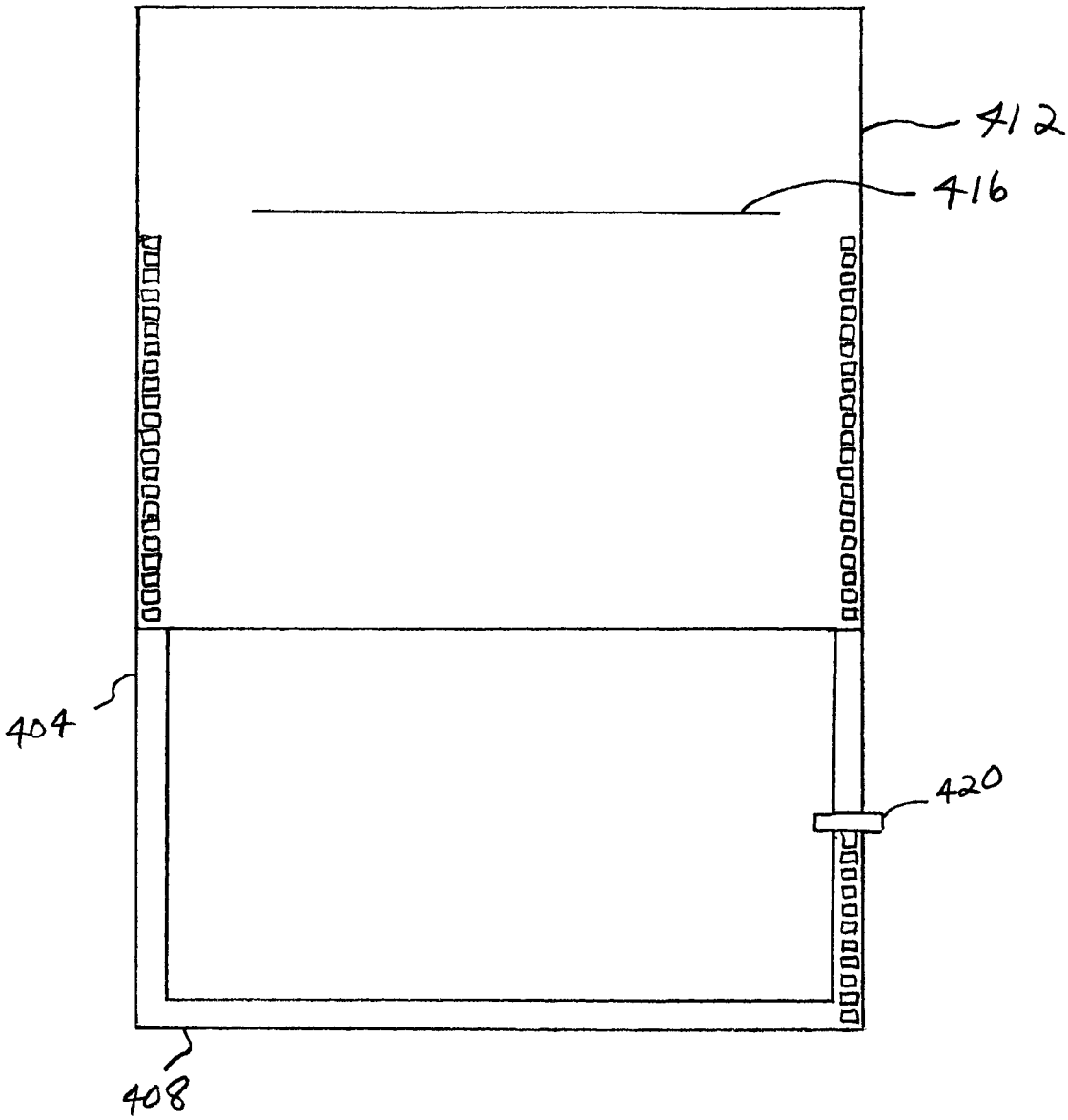
FIG. 10A illustrates a front view of an exercise and rehabilitation apparatus in accordance with an embodiment of the present invention.

FIG. 10A illustrates a front view of an exercise and rehabilitation apparatus 400 in accordance with an embodiment of the present invention. The exercise apparatus 400 is used to increase mobility in the posterior chain (upper body), and is used to exercise both the upper and lower body. The exercise apparatus 400 includes a frame 404 that has a registration portion 408. The exercise apparatus 400 also includes an adjustable wall 412 that is movably connected with the frame 404, to discretely move vertically with respect to the frame 404. The registration portion 408 is disposed at a bottom of the frame 404, and is horizontally spaced from the frame 404 (as shown, for example, in FIG. 11). According to one embodiment, the registration portion 408 includes a register that is spaced horizontally approximately three inches in front of the vertical plane of the adjustable wall 412. According to one embodiment, the registration portion 408 includes a register that is spaced horizontally approximately 12 inches in front of the vertical plane of the adjustable wall 412. According to one embodiment, the registration portion 408 includes a register that is spaced horizontally approximately 18 inches in front of the vertical plane of the adjustable wall 412.

The adjustable wall 412 includes a demarcation 416 for positioning the adjustable wall with respect to the frame 404 to properly position the exercise device with respect to a properly positioned user. Initially, the user vertically adjusts the adjustable wall 412 so that the demarcation 416 is substantially parallel to a top of the user's shoulders.

In operation, a user stands with their heels against the register of the registration portion 408 in front of the plane of frame 404 with their gluteus, back, and head against the adjustable wall 412 that connects to at least two sides of frame 404. The user also places the lateral side of their arms and back of hands flat against the adjustable wall 412 having their upper arms substantially parallel to the ground.

Once in this position, the user then rotates his pelvis by flattening the low back against the adjustable wall 412. With the low back flat it is suggested to slowly extend the arms up the wall while maintaining contact with his fingers, arms, head and entire back. While extending the arms up adjustable wall 412 in such a position the latisimus dorsi, pectorals, deltoids, rhomboids, teres muscles, and infra and supraspinatus elongate, providing relief from excessive joint stress that can be experienced by tightness in the above mentioned muscle groups.

The exercise device 400 also includes an adjustable bar 420 that is used for supine hip extensions (single or double leg). The adjustable bar 420 is movably connected to the frame 404 to discretely move vertically with respect to the frame 404. The discrete vertical movements of the adjustable bar 420 correspond to the desired difficulty of the supine hip extension. For example, the higher the adjustable bar 420 is set, the more difficult the supine hip extension. According to on embodiment, the frame 404 is labeled with generalized demarcations indication difficulty of supine hip extension correlated with height of the adjustable bar 420 on the frame 404 with respect to the ground. For example, the frame may be demarcated (for example, color coded and labeled) in several zones, indicating beginner, moderate, and advanced.

Figure 10B:
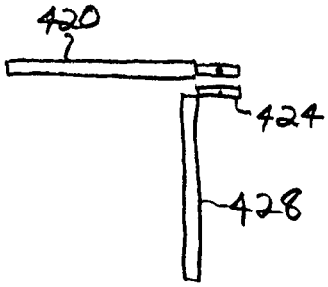
FIG. 10B illustrates a side view of an adjustable bar of the apparatus of FIG. 10A.

According to one embodiment, the adjustable bar 420 includes a base portion 424 that is movably connected to the frame 404, and a bar portion 428 that is hingedly connected to the base portion 424. As shown in FIG. 10B, when not in use, the bar portion 428 can be folded down with respect to the base portion 424, so that the adjustable bar 420 is substantially parallel with the frame 404, and thus, is out of the way. Conversely, when a user desires to use the adjustable bar 420, the user rotates the bar portion 428 up to a position that is substantially perpendicular to the plane of the adjustable wall 412, and locks the bar portion 428 with respect to the base portion 424.

In this supine hip extension exercise, the user lays supine on the ground with their heel(s) on bar 420 and feet dorsiflexed. From this position the user should extend the hips vertically maintaining his weight on the back portion of the heel(s) and the shoulder blades. By performing a hip extension in this way the user ensures that the gluteus and hamstrings are active at a high level, promoting increased intermuscular coordination patterns that have been proven to protect the knees and strengthen the efficiency of movements requiring gluteus and hamstring strength (for example, squatting, lunging, walking, running, and climbing).

Figure 11:
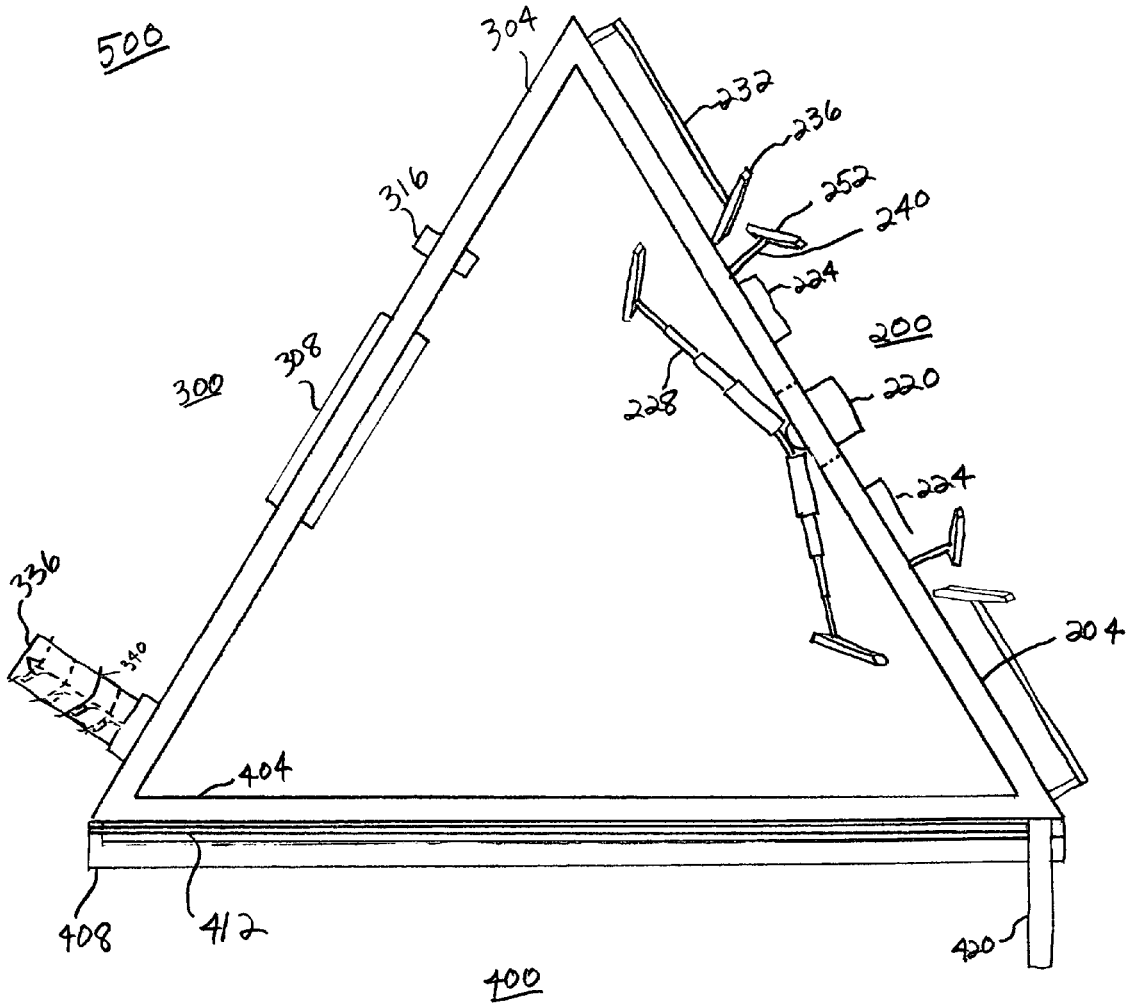
FIG. 11 illustrates a plan view of an exercise and rehabilitation apparatus in accordance with an embodiment of the present invention.

FIG. 11 illustrates a plan view of an exercise and rehabilitation apparatus 500 in accordance with an embodiment of the present invention. The exercise apparatus 500 combines the exercise apparatuses 200, 300, and 400 of FIGS. 8A, 9A, and 10A, respectively, into a triangular apparatus with each face of the triangle representing an exercise station. Repetition of the descriptions of the exercise apparatuses 200, 300, and 400 are omitted for brevity.

Embodiments of the instant invention and coordination training can further enhance application to current scientific knowledge regarding safe muscular coordination and improved joint integrity. Embodiments of the instant invention may not only be used as a means to enrich the overall medical rehabilitation industry but also it may be used as a means to enrich other human performance venues such as athletic performance related training, general fitness, cross training, alternative exercise routines, bodybuilding, and others.

Notably, embodiments of the instant invention allow rehabilitation patients and other users to execute important coordination, strength, and stability exercises in a straight forward manner, with minimal to no guidance from a physical therapist. Embodiments of the instant invention also provide a slight difference in directional resistance providing new coordination challenges, which are known to favor an increase in effectiveness of rehabilitation as far as overall medical improvement and length of time associated therewith.

Embodiments of the instant invention may also play a vital role for a physical therapist by providing new ways to stimulate important muscular activation and coordination patterns of a patient while ensuring that the patient is able to execute the movements singly, with minimal to no supervision.

Embodiments of the present invention provide an exercise device, and exercise device series and program that helps exercise and rehabilitate the whole body of an injured, physically limited, or healthy exerciser. Embodiments of the instant invention also offer a user the opportunity to avoid and/or minimize a common cycle of joint instability and interminable pain typically associated with well-known staunch exercises. Additionally, embodiments of the instant invention allow a user that is susceptible to such injury, which may typically be caused by imbalances in muscular coordination around a joint, to preventatively control or minimize susceptibility by building and developing increased and improved joint stability.

An embodiment of the instant invention includes a three or four part system that is attached by a main central frame in the form of a triangle. Additionally, an embodiment of the instant invention includes a four part system that is attached by a main central frame in the form of a square. Further, an embodiment of the instant invention may include a three or four part system that is all in separate units. A user is able to perform a full body rehabilitative regimen with little to no supervision to dynamically improve strength while gaining the necessary confidence of autonomy, vital to the success of any rehabilitative routine.

Although only a few embodiments of the present invention have been shown and described, the present invention is not limited to the described embodiments. Instead, it will be appreciated by those skilled in the art that changes may be made to these embodiments without departing from the principles and spirit of the invention, the scope of which is defined by the claims and their equivalents.

What is claimed is:

1. An exercise and rehabilitation apparatus, comprising:

a frame:

an exercise device movably supported on the frame;

a user positioning unit connected with the frame, for properly positioning a user with respect to the exercise device and the frame for performance of a predetermined exercise;

a device adjustment unit for positioning the exercise device with respect to the frame to properly position the exercise device with respect to a properly positioned user, to accommodate user size and shape diversity, the device adjustment unit permitting the exercise device to be alignable with a predetermined body part of the user; and a feedback unit providing feedback to the user to indicate whether the predetermined exercise is being performed correctly;

wherein the frame comprises first and second vertical supports and a table body disposed atop the vertical supports; and the exercise device comprises a pair of arms with respective handles, the arms being positionable in predetermined Y and T configurations with respect to the table body.

2. The apparatus according to claim 1, wherein the first and second vertical supports comprise a lift system for vertically positioning the table body.

3. The apparatus according to claim 1, wherein the device adjustment unit comprises a telescoping portion of the arms, telescoping to accommodate user arm-length diversity, such that the handles are alignable with the user's hands.

4. The apparatus according to claim 3, wherein in a storage position, the arms telescope to not extend laterally outside the table body.

5. The apparatus according to claim 1, wherein the device adjustment unit comprises an arm attachment unit disposed on the first vertical support and to which the arms are attached, the arms being movable longitudinally with respect to the table body along the arm attachment unit, such that in the T configuration, a user can align the telescoping arms with a top of the user's shoulders to properly position the telescoping arms.

6. The apparatus according to claim 5, wherein the apparatus further comprises instructions for positioning the telescoping arms with respect to a user's shoulders.

7. The apparatus according to claim 5, wherein the arm attachment unit comprises:

an attachment post connected with the first vertical support;

a carrier to which the arms are connected, the carrier being moveable along the attachment post; and a carrier position locking device to lock the position of the carrier with respect to the attachment post.

8. The apparatus according to claim 1, wherein the user positioning unit comprises a head pad connected at a first end of the table body, the head pad having a void therein for positioning a user's forehead on the head pad adjacent to the void and positioning the user's face in the void.

9. The apparatus according to claim 8, wherein the feedback unit comprises a biasing connector movably connecting the head pad and the table body, such that the head pad is vertically moveable with respect to the table body and biased so that a top surface of the head pad is substantially planar with a top surface of the table body, wherein a downward movement of the head pad with respect to the table body during performance of the exercise indicates improper performance of the exercise.

10. The apparatus according to claim 1, wherein:

the arms rotate vertically in the Y and/or T configurations with a selective predetermined resistance level, to perform the predetermined exercise; and the feedback unit comprises a collar permitting horizontal rotation of the arms only within a predetermined angular limit with respect to the Y and T configurations, such that horizontal rotation of an arm beyond the angular limit prevents vertical rotation of the arm, thereby indicating improper performance of the exercise.

11. The apparatus according to claim 1, wherein the arms rotate vertically in the Y and T configurations with a selective predetermined resistance level, to perform the predetermined exercise; and the feedback unit comprises a collar permitting rotation of the arms about a longitudinal axis of the arms but prevents vertical rotation of the arms if the rotation of the arms about the longitudinal axis of the arms exceeds a predetermined angular limit, thereby indicating improper performance of the exercise.

12. The apparatus according to claim 1, wherein:

the arms rotate vertically in the Y and T configurations with a selective predetermined resistance level, to perform the predetermined exercise; and the feedback unit comprises a collar permitting horizontal rotation of the arms only within a first predetermined angular limit with respect to the Y and T configurations, such that horizontal rotation of an arm beyond the first angular limit prevents vertical rotation of the arm, thereby indicating improper performance of the exercise;

wherein the collar also permits rotation of the arms about a longitudinal axis of the arms but prevents vertical rotation of the arms if the rotation of the arms about the longitudinal axis of the arms exceeds a second predetermined angular limit, thereby indicating improper performance of the exercise.

13. The apparatus according to claim 1, further comprising a rotational storage apparatus for storing exercise supplies, the rotational storage apparatus being rotatably connected to the table body such that in a storage position, the rotational storage apparatus does not extend laterally outside the table body.

14. The apparatus according to claim 13, wherein the rotational storage apparatus further comprises:

at least one resistance cable movably mounted to the rotational storage apparatus to extend and retract with respect to the rotational storage apparatus, the resistance cable having a handle thereon and being biased toward a retracted position; and at least one mounting site for mounting at least one resistance band.

15. The apparatus according to claim 1, wherein the device adjustment unit comprises:

a telescoping portion of the arms, telescoping to accommodate user arm-length diversity; and an arm attachment portion disposed on the first vertical support and to which the arms are attached, the arms being movable longitudinally with respect to the table body along the arm attachment, such that in the T configuration, a user can align the telescoping arms with a top of the user's shoulders to properly position the telescoping arms.

16. The apparatus according to claim 8, wherein the arms rotate vertically in the Y and T configurations with a selective predetermined resistance level, to perform the predetermined exercise; and the feedback unit comprises:

a collar permitting horizontal rotation of the arms only within a predetermined angular limit with respect to the Y and T configurations, such that horizontal rotation of an arm beyond the angular limit prevents vertical rotation of the arm, thereby indicating improper performance of the exercise; and a biasing connector movably connecting the head pad and the table body, such that the head pad is vertically moveable with respect to the table body and biased so that a top surface of the head pad is substantially planar with a top surface of the table body, wherein a downward movement of the head pad with respect to the table body during performance of the exercise indicates improper performance of the exercise.

17. An exercise and rehabilitation apparatus, comprising:

a frame;

exercise means for performance of a predetermined exercise, the exercise means being movably supported on the frame;

user positioning means for properly positioning a user with respect to the exercise device and the frame;

device adjustment means for positioning the exercise means with respect to the frame to properly position the exercise device with respect to the properly positioned user, to accommodate user size and shape diversity, the device adjustment means permitting the exercise means to be alignable with a predetermined body part of the user; and feedback means for providing feedback to the user to indicate whether the predetermined exercise is being performed correctly;

wherein the frame comprises first and second vertical supports and a table body disposed atop the vertical supports; and the exercise means comprises a pair of arms with respective handles, the arms being positionable in predetermined Y and T configurations with respect to the table body.

* * * * *